US007714494B2

(12) United States Patent
Foo

(10) Patent No.: US 7,714,494 B2
(45) Date of Patent: May 11, 2010

(54) PLUG-IN FLUORESCENT LAMP AND LAMP HOLDER USED THEREWITH

(75) Inventor: Onn Fah Foo, Kowloon (HK)

(73) Assignee: Mass Technology (H.K.) Ltd., Kowloon (HK)

( * ) Notice: Subject to any disclaimer, the term of this patent is extended or adjusted under 35 U.S.C. 154(b) by 218 days.

(21) Appl. No.: 11/872,761

(22) Filed: Oct. 16, 2007

(65) Prior Publication Data

US 2008/0088218 A1 Apr. 17, 2008

(30) Foreign Application Priority Data

Oct. 17, 2006 (CN) ..... 2006 1 0137395
Aug. 3, 2007 (CN) ..... 2007 1 0140811

(51) Int. Cl.
*H01J 5/48* (2006.01)

(52) U.S. Cl. ..... 313/318.01; 313/318.09

(58) Field of Classification Search ..... 313/318.09, 313/318.01; 439/439
See application file for complete search history.

(56) References Cited

U.S. PATENT DOCUMENTS 5,634,820 A * 6/1997 Vakil ..... 439/646
6,582,253 B1 * 6/2003 Lau ..... 439/646

* cited by examiner

*Primary Examiner*—Vip Patel
(74) *Attorney, Agent, or Firm*—Rabin & Berdo, P.C.

(57) ABSTRACT

A split fluorescent lamp comprising a lamp body having a pluggable lamp cap and a lamp base with which the pluggable lamp cap is engaged, characterized in that an electronic ballast is embedded in the pluggable lamp cap, wherein the overall dimension of the lamp body and lamp base being assembled together is substantially equivalent to that of a G23 or G24 type plug-in fluorescent lamp such that it can be used to replace the plug-in fluorescent lamp of prior art adopted in a light fixture without changing the original design and power supply thereof.

9 Claims, 7 Drawing Sheets

PLUG-IN FLUORESCENT LAMP AND LAMP HOLDER USED THEREWITH

TECHNICAL FIELD

The present invention relates to an insertable fluorescent lamp, and more particularly to a new plug-in fluorescent lamp comprising a pluggable lamp cap having an embedded electronic ballast and a lamp base adapted for use therewith.

BACKGROUND OF THE INVENTION

A commonly available split fluorescent lamp, such as a G23 or G24 plug-in type fluorescent lamp, is adapted for use in various light fixtures and generally comprising a lamp tube having a pluggable lamp cap and a lamp base adapted for engaging with the pluggable lamp cap and coupling with a ballast mounted in a light fixture. Under normal circumstances, the ballast in the light fixture can last for 5~6 times longer than the lamp tube such that replacement of used lamp tube needs to be done for a couple of times during its lifetime. While replacing the used lamp tube with a new one which is however usually having operation parameters not in prefect match with that of the original ballast whereby rendering the lifespan of the new lamp tube to be shortened. Further, it is extremely inconvenient to replace or repair the ballast in the light fixture when the ballast is found to be faulty during its operation as the dismantling of the same is rather difficult. Though such split fluorescent lamp might be replaced by a regular integrated compact type fluorescent lamp, but the original illumination effect of the light fixture cannot be maintained without adaptive adjustment in the original design of the light fixture and such adjustment will bring additional cost and is thus somewhat uneconomical.

SUMMARY OF THE INVENTION

A plug-in fluorescent lamp of the present invention overcomes at least partly the above defects in the prior art. To this end, the present invention provides an improved split fluorescent lamp, which comprises a lamp body having a pluggable lamp cap and a lamp base with which the pluggable lamp cap is engaged, characterized in that an electronic ballast is embedded in the pluggable lamp cap.

According to the present invention, the pluggable lamp cap further comprises a casing and a plug-in unit arranged on top of the casing.

According to an embodiment of the present invention, the plug-in unit further comprises a couple of recesses arranged at two edges on the top of the casing, electrical contact elements arranged in the recesses, and a positioning element arranged on at least one lateral walls of the plug-in unit. The positioning element can be a protrusion or a recession of triangular configuration arranged on a lateral wall of the recess.

The lamp base comprises a mainbody defining a cavity for receiving the pluggable lamp cap and a reception member arranged at top of the cavity for coupling with the plug-in unit.

The reception member comprises a profile element for plugging into the recess, and an optional locking element being arranged at a position corresponding to the positioning element for plug-in coupling with the positioning element, wherein conductive elements being arranged in the profile element for electric coupling with the electrical contact elements.

Accordingly, the locking element is a bended resilient element of triangular configuration in match with the positioning element, while in engagement with the positioning element, the bended portion of the locking element is located under the protrusion or within the recession to fix the positioning element.

According to another embodiment of the present invention, the protrusion or recession of the positioning element can be selectively of semicircular configuration; and the locking member can be correspondingly a resilient element having a portion of semicircular configuration such that the semicircular portion of the locking member can be firmly connected with the protrusion or recession of the positioning element whereby fixing the positioning element in place.

According to another embodiment of the present invention, the overall dimension of the lamp body and lamp base being assembled together is substantially equivalent to that of a G23 or G24 type plug-in fluorescent lamp. In this regard, when a G23 or G24 type plug-in fluorescent lamp used by a light fixture is broken, one can use the split fluorescent lamp of the present invention as replacement for achieving equivalent illumination effect. As the ballast is embedded in the plug-in fluorescent lamp of the present invention, the working parameters of the lamp tube can be optimized with respect to the ballast such that the lifespan of the lamp tube can be extended to 15,000 hours which is approximately 1.5 to 2 times than that of a regular one. Therefore, the plug-in fluorescent lamp of the present invention possesses all the advantages of usual plug-in fluorescent lamps, and accordingly, its scope of application will be substantially larger than that of existing plug-in fluorescent lamp.

BRIEF DESCRIPTION OF THE DRAWINGS

The further advantages and characteristics of the present invention will be more obvious by way of detailed description of several exemplary and non-limitative examples with reference to the accompany drawings.

DETAILED DESCRIPTION OF THE PREFERRED EMBODIMENTS

Figure 1:
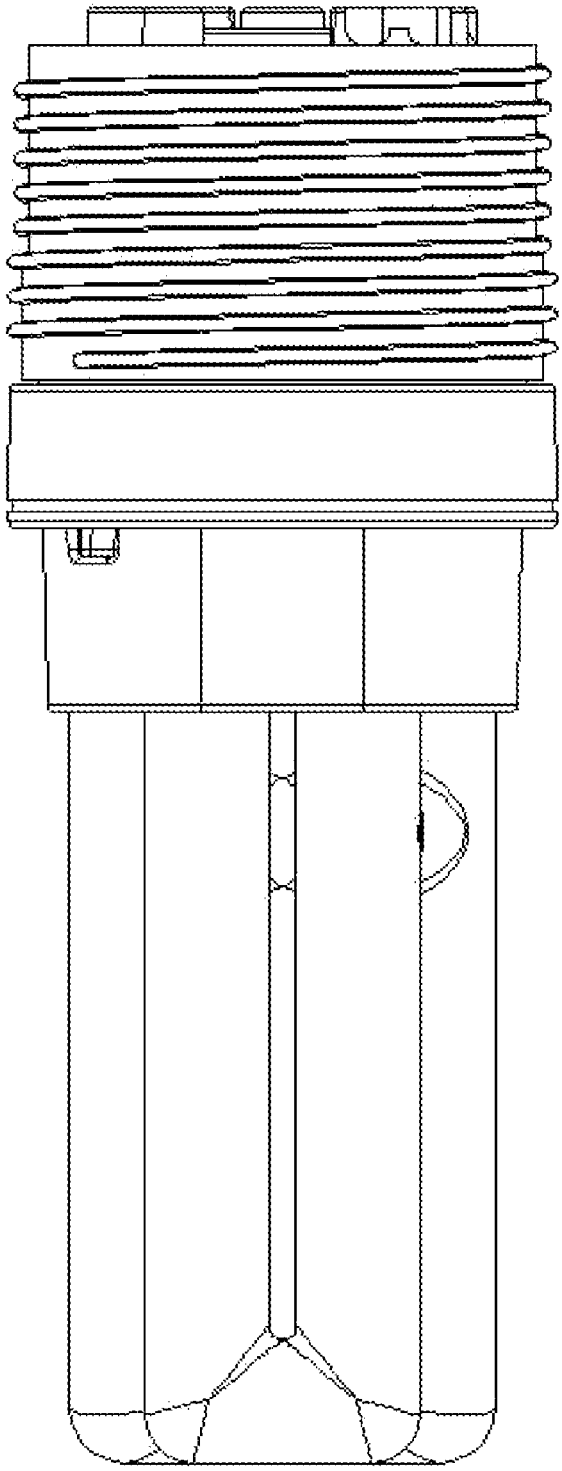
FIG. 1 is a schematic view of an integrated plug-in fluorescent lamp of a preferred embodiment of the present invention.

Referring to FIG. 1, which is a schematic view of an integrated plug-in fluorescent lamp according to a preferred embodiment of the present invention, wherein a lamp body having a pluggable lamp cap is engaged with a complementary lamp base.

Figure 2A:
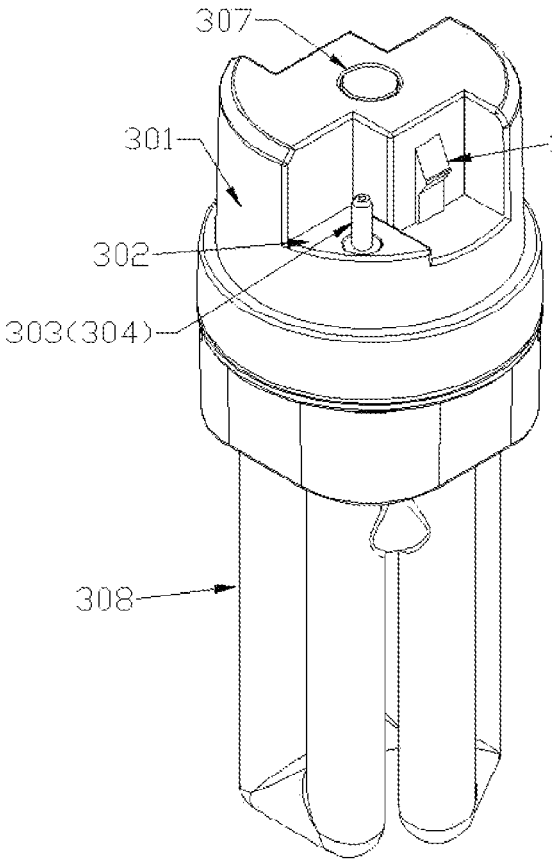
FIGS. 2*a* and 2*b* are schematic views of a lamp body having a pluggable lamp cap of the plug-in fluorescent lamp as shown in FIG. 1.
Figure 2B:
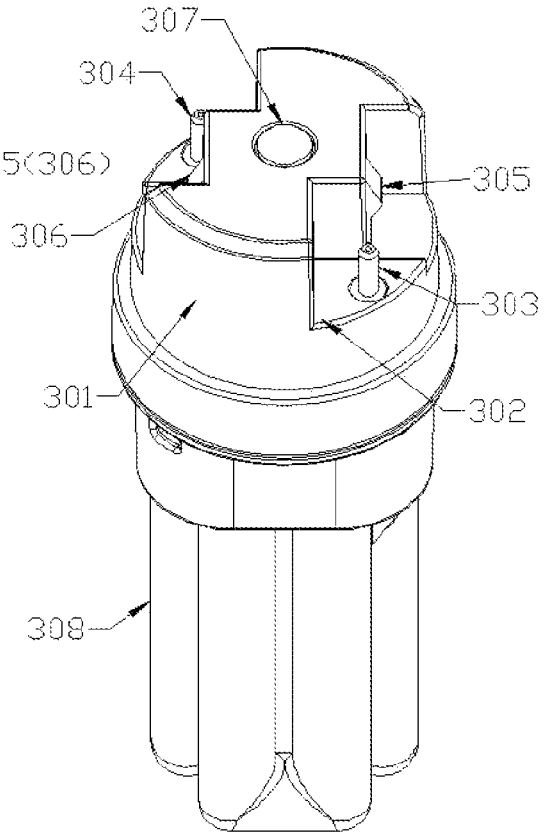
Figure 3:
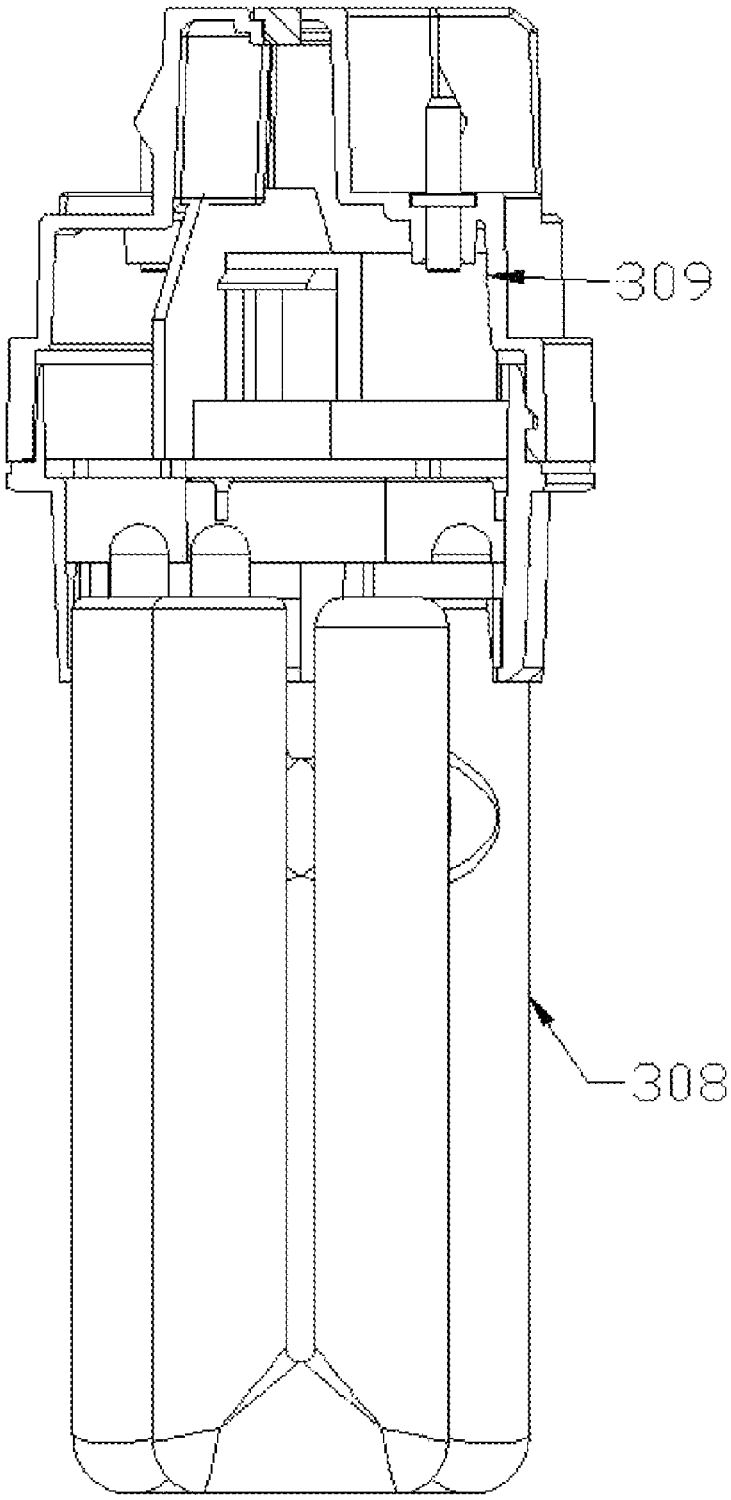
FIG. 3 is a sectional view of the lamp body having a pluggable lamp cap as shown in FIG. 2.

FIGS. 2*a*, 2*b* and 3 are schematic and sectional views of the plug-in fluorescent lamp, which comprises a casing 301, an electronic ballast 309 embedded in the casing, a plug-in unit arranged on top of the casing and a lamp tube 308.

The plug-in unit comprises a couple of recesses 302 arranged oppositely at two edges on the top of the casing, which is preferably of triangular or any other configuration such as rectangular, polygonal or elliptical configurations. Electrical contact elements 303, 304 coupled with the ballast 309 are arranged in the recesses, which are two regular columniform metal rods according to the embodiment. At least one positioning elements 305, 306 can be arranged on at least one lateral walls of the plug-in unit for proper positioning. As shown in the figure, the protrusion or recession of the positioning element is of triangular configuration, which is preferably incorporated into the lateral wall or can be mounted thereon by means of connection elements such as bolts and screws for the ease of replacement. According to the embodiment, one positioning element is arranged on each left and right lateral walls of the plug-in unit for a better engagement therebetween. It should be understood that the dimension of the plug-in unit is devised with respect to the dimension of the existing G23 or G24 plug-in florescent lamp for the ease of user manipulation and employment in various light fixtures. For example, the protrusion or recession of the positioning element can be selectively of semicircular configuration and can be arranged on the electrical contacts elements, for instance, it can be a circular boss at top end of the metal rod for coupling with corresponding locking mechanism, in that case, no positioning element is required on the lateral walls of the plug-in unit.

On the top of the casing of the plug-in fluorescent lamp a circular central aperture 307 covered with a cover plate (not shown) is provided such that thermal paste can be injected via the aperture for heat dissipation after the assembling of the fluorescent lamp whereby decreasing the temperature of the electronic devices of the ballast, and then the aperture can be covered with the cover plate. The size of the aperture is arbitrary and can be adjusted for the ease of user manipulation.

Figure 4:
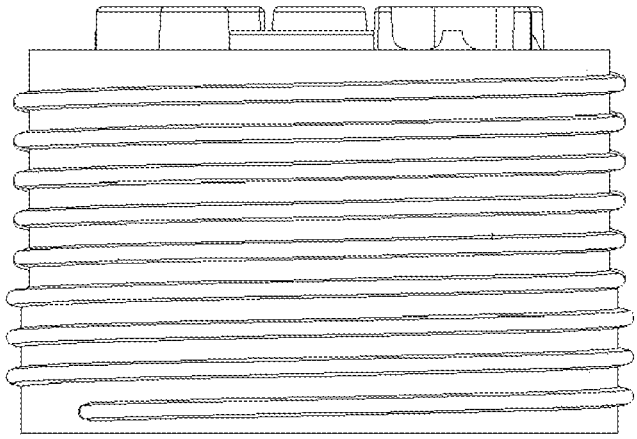
FIG. 4 is a schematic view of a lamp base matching with the pluggable lamp cap as shown in FIG. 2.
Figure 5A:
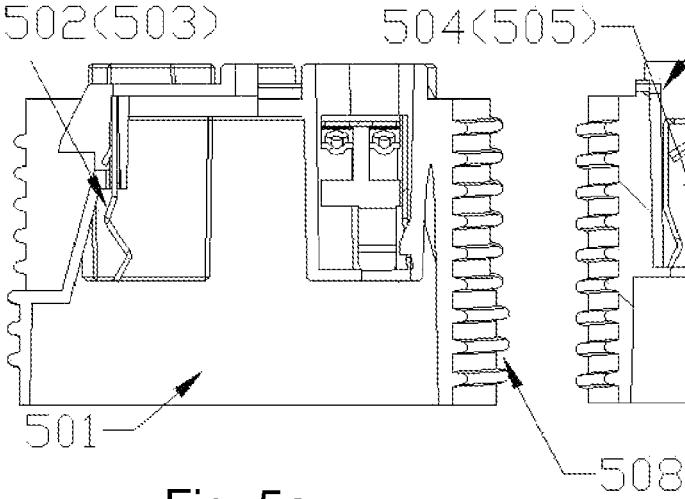
FIGS. 5*a* and 5*b* are sectional views of the lamp base as shown in FIG. 4.
Figure 5B:
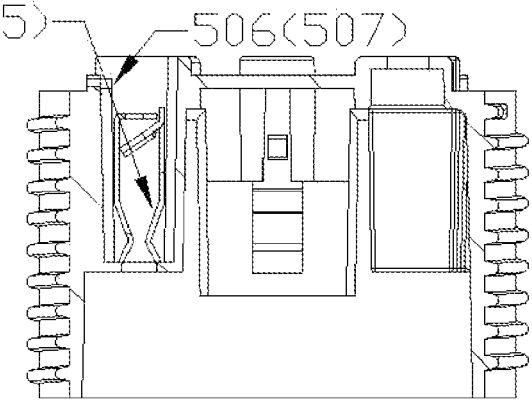
Figure 6:
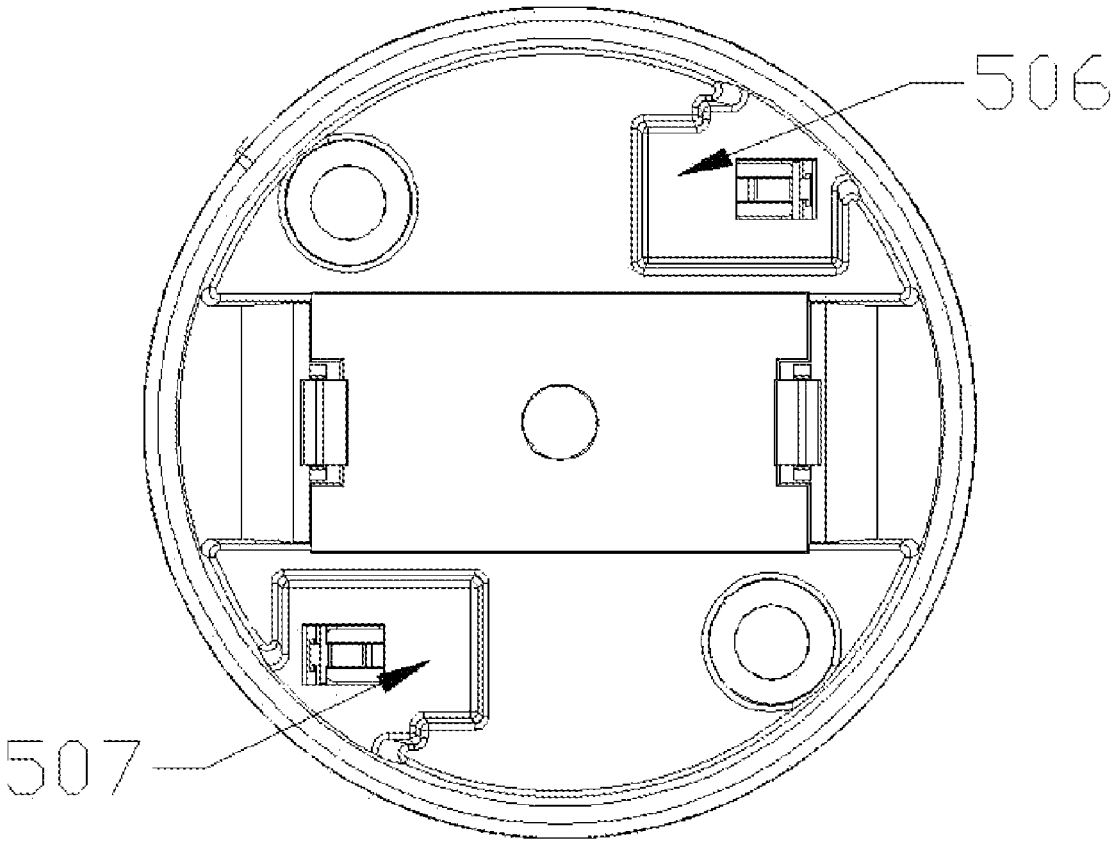
FIG. 6 is a top view of the lamp base as shown in FIG. 4.

FIGS. 4, 5*a* and 5*b* are respectively the schematic and sectional views of a lamp base matching with the pluggable lamp cap as shown in FIG. 2, and FIG. 6 is a top view of the lamp base as shown in FIG. 4.

As can be seen, the lamp base comprises a mainbody 501 defining a cavity for receiving the pluggable lamp cap and a reception member arranged at top of the cavity for coupling with the plug-in unit. The outside of the mainbody provides with a male thread 508. The reception member comprises a profile element 506, 507 for plugging into the recess, and an optional locking element 502, 503 being arranged at a position corresponding to the positioning element for plug-in coupling with the positioning element. According to this embodiment, the cross section of the profile element assumes a triangular shape, or it can be in rectangular form for matching with the recess, and wherein a conductive element 504, 505 is arranged in each profile element for electric coupling with the electrical contact elements. According to the embodiment, the conductive element is a metal contact plate having its one end coupled with a power line and its another end coupled with the metal rod of the lamp body. As can be seen, the end coupled with the power line can be mounted in the profile element 506, 507, wherein the profile element 506, 507 as shown is a column matching with the triangular recess to further facilitates the positioning of the lamp body in the lamp base. In addition, the end coupled with the metal rod of the lamp body assumes a Ω-shape or the like which can elastically deformed to provide an appropriate clamping force for holding the lamp body in position while the metal rod is inserted thereinto. With adoption of suitable material and adaptive adjustment of the clamping force, the lamp body can be held in the absence of any other locking mechanism by virtue of the intimate coupling between the profile element and the recess together with the intrinsic clamping force of the conductive element 504, 505. In order to match with the positioning element and ensure the proper mounting of the lamp body in the lamp base, the reception member comprises at least one locking element 502, 503, which can be a bended resilient element corresponding to the positioning element. When it engages with the positioning element, the bended portion of the locking element is located under the protrusion or within the recession to secure the positioning element. The resilience of the resilient element can be adjusted properly such that a user can pull out the used lamp body from the lamp base for replacement by applying a specific pulling force to deform and displace outwardly the ends of the resilient element.

According to another embodiment of the present invention, the resilient element of the locking element can be devised to comprise a concave or convex semicircular portion with respect to the design of the positioning element. In this regard, its concave or convex semicircular portion can be in intimate contact with the corresponding protrusion or recession for locking up the positioning element when it is coupled therewith.

Figure 7A:
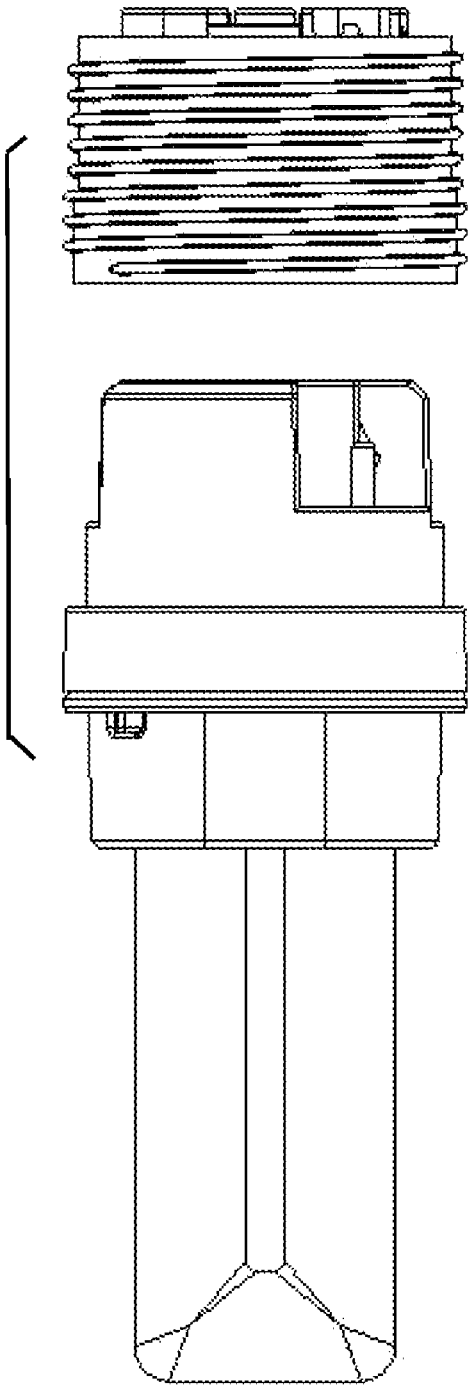
FIG. 7*a* is a schematic view of a lamp body and a lamp base of a plug-in fluorescent lamp of the present invention in separated position.
Figure 7B:
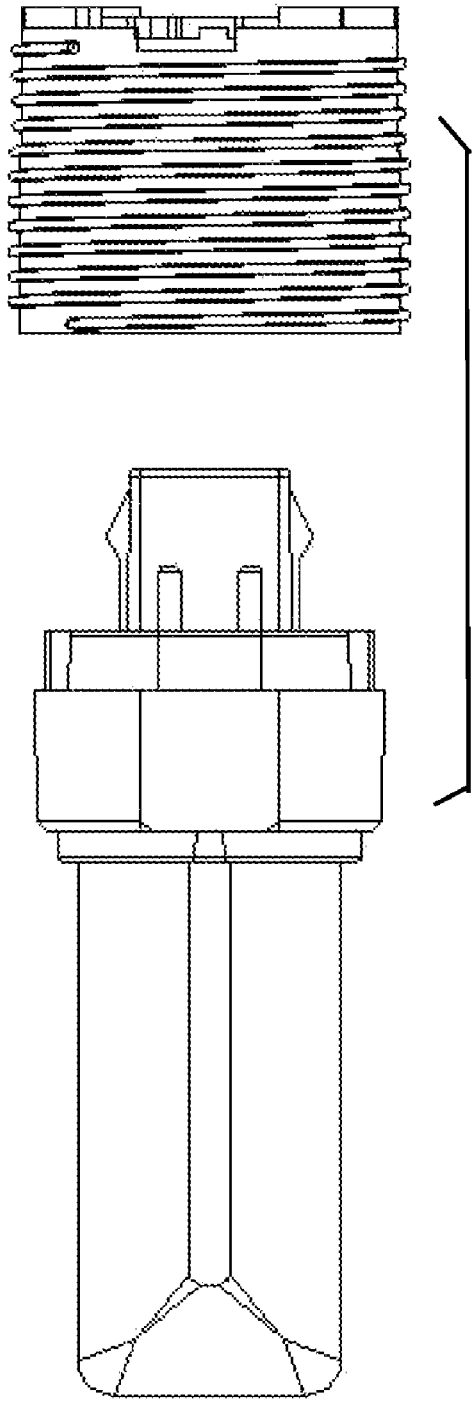
FIG. 7*b* is a schematic view of a lamp body and a lamp base of a regular G23 or G24 type plug-in fluorescent lamp in separated position.

As previously noted, another object of the present invention is to replace the existing G23 or G24 type plug-in fluorescent lamp. As can be seen from FIGS. 7*a* and 7*b*, a lamp body and a lamp base of a plug-in fluorescent lamp of the present invention in separated position are similar to or the same as that of a regular G23 or G24 type plug-in fluorescent lamp in terms of both their appearance and dimension.

Figure 8A:
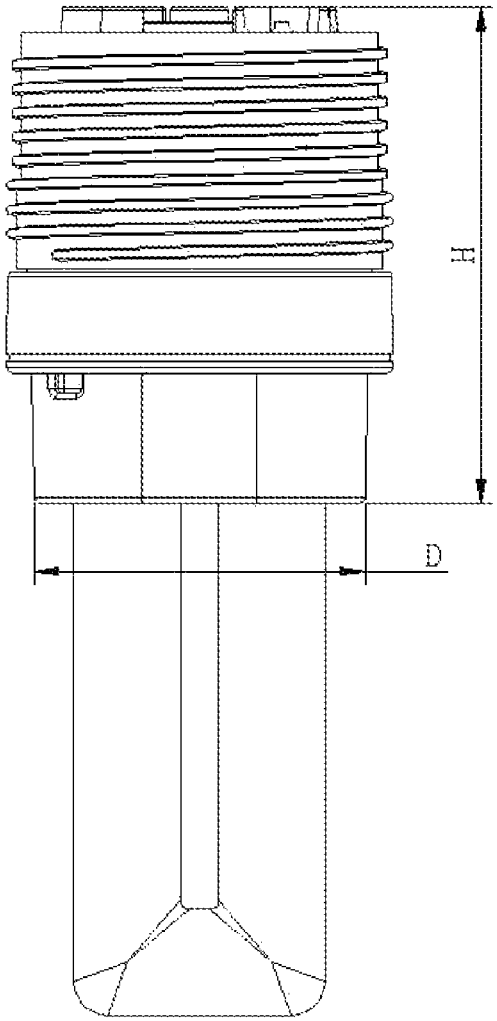
FIGS. 8*a* and 8*b* are schematic views of the combined lamp body and lamp base of the plug-in fluorescent lamps as shown in FIGS. 7*a* and 7*b*, respectively.
Figure 8B:
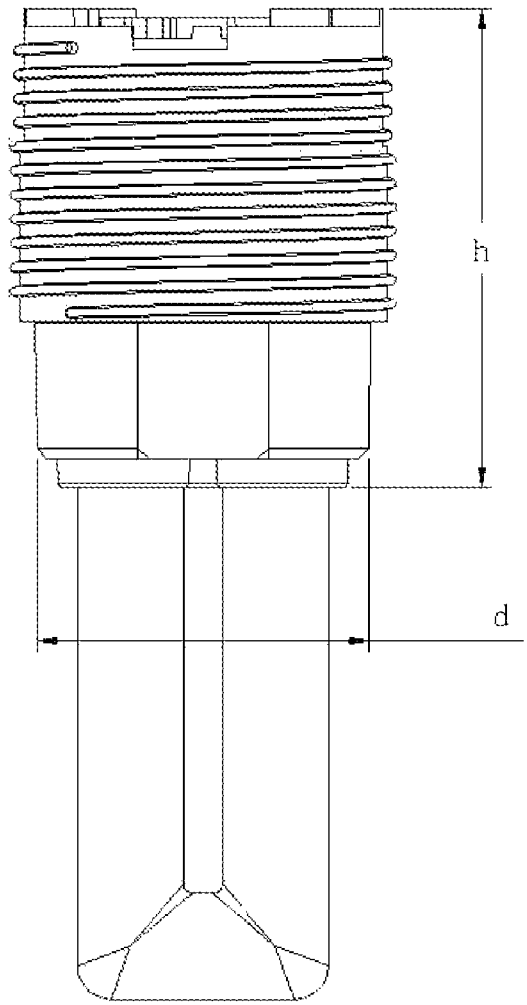

As shown in FIGS. 8*a* and 8*b*, when the lamp body is engaged with the corresponding lamp base, their overall dimension is roughly the same or equivalent to each other, wherein H and h are respectively the distance between the top of the lamp base and the lamp tube, D and d represent respectively the width of the lamp body. The wattage of the plug-in fluorescent lamp of the present invention and the G23, G24 type plug-in fluorescent lamp is the same such that the G23, G24 type plug-in fluorescent lamp adopted in a light fixture can be directly replaced by the plug-in fluorescent lamp of the present invention without changing the original design and power supply of the light fixture.

It should be understood that the plug-in fluorescent lamp of the present invention can be made to be smaller than the G23, G24 type plug-in fluorescent lamp while the illuminance thereof can be remained unchanged or better. As it does not require an additional, relatively larger and heavier external ballast, its scope of application is much larger than that of the G23, G24 type plug-in fluorescent lamp and it can also reduce the overall size and weight of the light fixture. Further, the electronic ballast embedded in the plug-in fluorescent lamp of the present invention can ensure the performance of the fluorescent lamp to be optimized and the lifespan to be maximized such that frequent replacement of used lamps is avoided. Therefore, it can not only be used to replace the existing G23 or G24 type plug-in fluorescent lamp but can also be employed in other light fixtures which were previously restricted by the limitation on the dimension and specification of the prior art and were thus unable to employ the existing plug-in fluorescent lamps. It is because the present invention incorporates one of the latest compact type electronic ballast which enables the size of the lamp body to be minimized per request. With the plug-in fluorescent lamp of the present invention, light fixtures manufacturer will have a greater flexibility in the design of their product that results in a better appearance of their product and in turn a greater attraction to consumers is created.

It should be appreciated that the above are only some exemplary embodiments of the present invention, it will be obvious to those skilled in the art that various alteration and modification may be made to various elements employed therein for adaption to different light fixtures or applications, and all such alteration and/or modification shall fall into the scope of the present invention and the present invention is not limited by the embodiments set forth hereinbefore.

What is claimed is:

1. A plug-in fluorescent lamp comprising:

a lamp base;

a lamp body having a lamp cap plugged into the lamp base; and an electronic ballast embedded in the lamp cap.

2. A plug-in fluorescent lamp according to claim 1, wherein the lamp cap further comprises a casing and a plug-in unit arranged on top of the casing.

3. A plug-in fluorescent lamp according to claim 2, wherein the plug-in unit further comprises a pair of recessed portions arranged at two edges on the top of the casing and electrical contact elements arranged in the recessed portions.

4. A plug-in fluorescent lamp according to claim 3, wherein the plug-in unit further comprises a positioning element arranged on at least one lateral wall of the plug-in unit.

5. A plug-in fluorescent lamp according to claim 4, wherein the positioning element is a protrusion or a recession formed on one lateral wall of the recessed portion.

6. A plug-in fluorescent lamp according to claim 5, wherein the protrusion or recession of the positioning element is of a triangular shape.

7. A plug-in fluorescent lamp according to claim 5, wherein the protrusion or recession of the positioning element is of a semicircular shape.

8. A plug-in fluorescent lamp according to claim 1, wherein the dimensions of the lamp body and lamp base as assembled are equivalent to that of a G23 or G24 type plug-in fluorescent lamp.

9. A plug-in fluorescent lamp according to claim 1, wherein the lamp body further comprises a lamp tube.

* * * * *